US005197274A

United States Patent [19]

Braun

[11] Patent Number: 5,197,274

[45] Date of Patent: Mar. 30, 1993

[54] LINK ASSEMBLY FOR A WATCH BRACELET

[75] Inventor: Refael Braun, Flushing, N.Y.

[73] Assignee: E. Gluck Corporation, Long Island City, N.Y.

[21] Appl. No.: 775,858

[22] Filed: Oct. 15, 1991

[51] Int. Cl.[5] ..... F16G 13/00

[52] U.S. Cl. ..... 59/80; 59/78; 59/84; 63/4

[58] Field of Search ..... 59/901, 78, 82, 84, 59/86; 474/219, 220, 222, 224; 63/4, 9

[56] References Cited

U.S. PATENT DOCUMENTS

| | | | |
|---|---|---|---|
| 3,309,864 | 3/1967 | Arndt et al. | 474/222 |
| 3,439,494 | 4/1969 | Hutton et al. . | |
| 3,463,026 | 8/1969 | Staub et al. | 474/224 |
| 3,604,203 | 9/1971 | Hofmann . | |
| 3,707,072 | 12/1972 | Elsasser . | |
| 3,726,569 | 4/1973 | Maglio et al. | 474/222 |
| 3,837,163 | 9/1974 | Fujimori . | |
| 4,010,604 | 3/1977 | Tesch . | |
| 4,269,026 | 5/1981 | Bulle et al. . | |
| 4,781,035 | 11/1988 | Gagnebin et al. | 63/4 |
| 4,928,504 | 5/1990 | Tuppini . | |

FOREIGN PATENT DOCUMENTS

| | | | |
|---|---|---|---|
| 0196996 | 10/1986 | European Pat. Off. | 59/82 |
| 2453678 | 11/1974 | Fed. Rep. of Germany . | |
| 2227155 | 7/1990 | United Kingdom | 63/4 |

*Primary Examiner*—David Jones

*Attorney, Agent, or Firm*—Gottlieb, Rackman & Reisman

[57] ABSTRACT

A link assembly for a watch or other type of link bracelet is described. The link assembly includes a first link member having a first bore running therethrough and a second link member having a second bore running therethrough axially aligned with the first bore. A longitudinal pin having a non-threaded portion is extended through the first bore and a portion of the second bore for enabling the first link member to pivotally rotate with respect to the second link member. A threaded screw is used to occupy at least some of the remaining portion of the second bore for maintaining the non-threaded pin within the two bores.

33 Claims, 8 Drawing Sheets

LINK ASSEMBLY FOR A WATCH BRACELET

BACKGROUND OF THE INVENTION

This invention is directed to a link assembly for a link bracelet, and more particularly to a link assembly for a jewelry or watch bracelet having an improved coupling arrangement.

In the watch industry, interconnected links for jewelry-type bracelets and bands have been used for many years. Although there has been no lack of attention to the aesthetics of links or their cosmetic details (e.g., shape, style, finish, etc.), problems do arise as a result of the connections between adjacent links. Specifically, such problems come about when bracelets need to be lengthened or shortened, when maintenance needs to be done thereon, or when the links come apart on their own due to some malfunction in the coupling arrangement.

For several years, links of bracelets and bands were connected by virtue of screw fittings. Small screws would be inserted on one side of the bracelet into the outer edge of the link and would be received on the other side within a threaded aperture passing all the way from the outer link and would be aligned with an inner or nesting link or links. Thus, the screw would act both to hold the links together and as a pivot pin or rotation point for the links with respect to each other.

Despite the benefits of using a screw fitting arrangement in bracelet or watch band link assemblies, the use of screw fittings was less than desirable. Frequently, the screws of such assemblies would tend to loosen as a result of repeated pivoting of one link in the assembly with respect to its adjacent links. Sometimes, one of the screws would come out and be lost, causing loss of complete watch or damage when it falls down or at least requiring the wearer to go to a jeweler to replace the screw member if available. (As a result, there was a gradual trend away from the use of screws and threaded bores in jewelry link assemblies.)

A more recent alternative was the use of pin arrangements in bracelet link construction. Such pins were fitted into the slots or bores of interconnected links. Despite the advantage of using a pin arrangement over a screw fitting arrangement in link construction, the use of pins was also less than desirable. In particular, while the pins once properly fitted, did not come out on their own during usage and wear of the link assembly, there were difficulties in adjusting the pins during assembly of the bracelet. The need for very special tools and very skilled technician expert in each individual type of assembly, not available and known to each individual jeweler, became a must. Also, problems arose with respect to lengthening or shortening link bracelets, all resulting in large volume initial defects and premature field failures.

Accordingly, it would be desirable to overcome some of the foregoing problems inherent in the use of pin arrangements in a bracelet assembly by turning again to a screw fitting arrangement. However, such an arrangement must be modified.

SUMMARY OF THE INVENTION

Generally speaking, in accordance with the invention, a link assembly for a watch or other type of link bracelet is described. The link assembly includes a first link member having a first bore running therethrough and a second link member having a second bore running therethrough axially aligned with the first bore. A longitudinal pin having a non-threaded portion is extended through the first bore and through a portion of the second bore for enabling the first link member to pivotally rotate with respect to the second link member. A threaded screw is used to occupy at least some of the remaining portion of the second bore for maintaining the non-threaded pin within the two bores.

In a more specific embodiment, a central link member is pivotally connected to a forked link member by means of a pin inserted entirely through the single bore of the central link member and partially through at least one of the aligned bores in the forked link member. The remaining portions of bores in the forked link member are occupied by set screws in different orientations relative to the pivotally connecting pin.

The link assembly of the invention is advantageous in that the pivoting of one link relative to another link is accomplished via a non-threaded pin. Consequently, the pivoting action of the links does not result in the unscrewing of the connecting pin between the two links.

The purpose of the set screws is to maintain the pin in position—the set screws are not involved in the pivoting action of the two links. In other words, the set screws maintain the non-threaded pin within the bore of the central link member, preventing the pin from slipping or moving in either axially direction.

As a result of the inventive link assembly and the specific arrangement of the pin and set screws, the pivoting process of the assembly does not result in the screws becoming loose, in contrast to those assemblies in the prior art.

In an alternative embodiment, the inventive link assembly may also be used to connect three rows of links.

Accordingly, it is an object of the invention to provide an improved link assembly that is suitable for a jewelry or watch bracelet.

Another object of the invention is to provide a link assembly which uses a non-threaded pin to enable pivotal rotation of adjacent links.

Yet a further object of the invention is to provide a link assembly which includes set screws or screw members which are not easily loosened.

Still another object of the invention is to provide a link assembly which includes a separate hinge element and a separate coupling to maintain the connection of adjacent links all secured unable to fall off.

Still other objects and advantages of the invention will in part be obvious and will in part be apparent from the following description.

The invention accordingly comprises the features of construction, combination of elements, and arrangement of parts which will be exemplified in the constructions hereinafter set forth, and the scope of the invention will be indicated in the claims.

BRIEF DESCRIPTION OF DRAWINGS

For a fuller understanding of the invention, reference is made to the following description taken in connection with the accompanying drawings, in which.

DETAILED DESCRIPTION OF THE PREFERRED EMBODIMENTS

Figure 1:
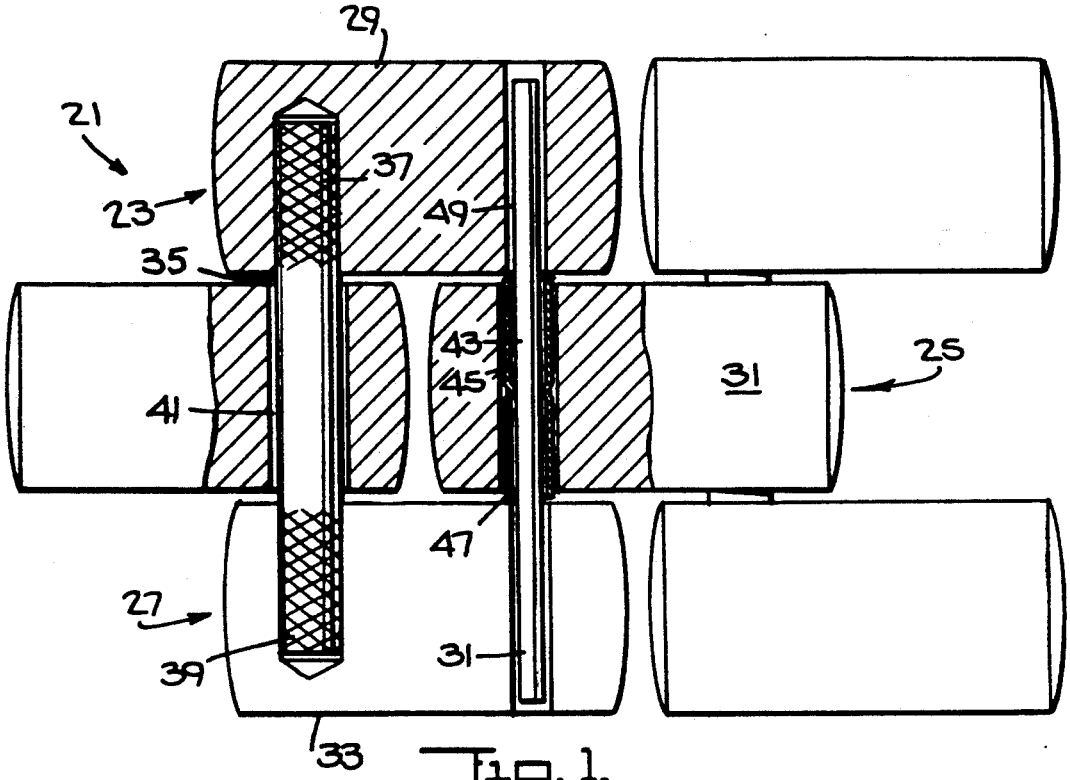
Fig. 1. PRIOR ART
FIG. 1 is a cross-sectional view of a three row link assembly in accordance with the prior art.

FIG. 1 is directed to a link assembly 21 made in accordance with the prior art. Link assembly 21 includes three rows of links, namely upper row 23, middle row 25 and bottom row 27 respectively. Upper row 23 includes a plurality of link members 29, while lower row 27 includes a plurality of link members 33. Link members 29 and 33 are substantially aligned. Middle row 25 includes a plurality of link members 31 disposed in an offset relationship with respect to link members 29 and 33, as illustrated in FIG. 1.

Each of middle link members 31 includes a first bore 41 located in the right portion of link member 31 and a second bore 47 located in the left portion of link member 31. Bore 41 receives a longitudinally extending friction pin 35 having an etched top portion 37 and an etched bottom portion 39. Each of etched portions 37 and 39 are force fit into upper link member 29 and lower link member 33 respectively, as shown in FIG. 1, in order to hold friction pin 35 in place.

Bore 47, which is disposed through the left portion of middle link member 31, is aligned with bores 49 and 51 of upper link member 29 and lower link member 33 respectively, as illustrated in FIG. 1, when assembling link assembly 21. Bores 47, 49 and 51 receive therein a longitudinally extending pin 43. Pin 43 is provided with a sleeve surrounding its central portion; therefore sleeve 45 is located only within bore 47 of middle link member 31.

Although each of middle link members 31 is pivotally rotatable with respect to upper and lower link members 29 and 33 (by means of pin 43 and 35), link assembly 21 is less than desirable. The etched top and bottom portions 37 and 39 of friction pin 35 may be worn out during assembly if the holes or grooves dug out in each of link members 29 and 33 are too tight. On the other hand, if the holes are too wide, the textured regions of each of etched portions 37 and 39 will not "catch" the surface of the holes.

In addition, there is difficulties in assembly and construction in terms of proper matching of pin 43 and sleeve 45 as well as in adjusting the position of pin 43 relative to sleeve 45.

Figure 2:
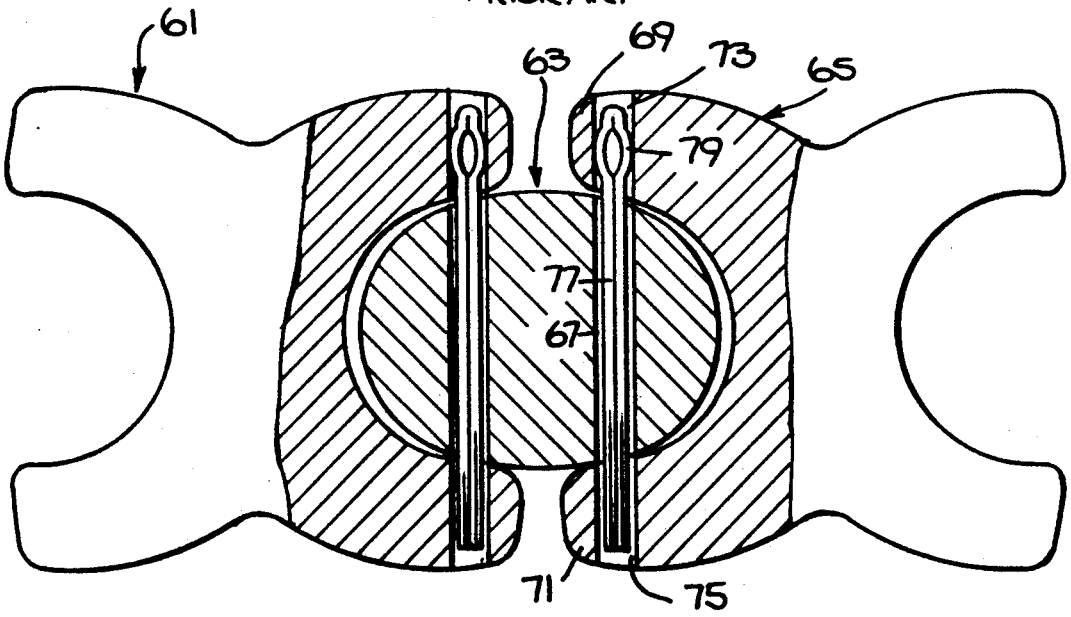
Fig. 2. PRIOR ART
FIG. 2 is a cross-sectional view of a solid friction pin and pin and tube connection link assembly for a bracelet having a central link member and an interconnected forked link member in accordance with the prior art.

In FIG. 2, a forked link assembly 61 made in accordance with the prior art is shown. Link assembly 61 includes a central link member 63 and a forked link member 65 fitted about central link member 63. Central link member 63 includes a bore 67 adapted for receiving a pin 77, as described below. Forked link member 65 includes a pair of arms 69 and 71 each provided with a bore 73 and 75 respectively.

In assembly, bore 67 of central link member 63 is aligned with bores 73 and 75 of forked link member 65 for defining a longitudinally extending opening through which pin 77 is inserted. Pin 77 includes an enlarged bulbous end 79 for making frictional contact with the inside surface of bore 73 in arm 69. The remaining portion of pin 77 passes through central link member 63 by means of bore 67 as well as lower bore 75 in lower arm 71.

Assembly 61 is not desirable since difficulties are encountered in adjusting the pins in the aligned bores.

Figure 3:
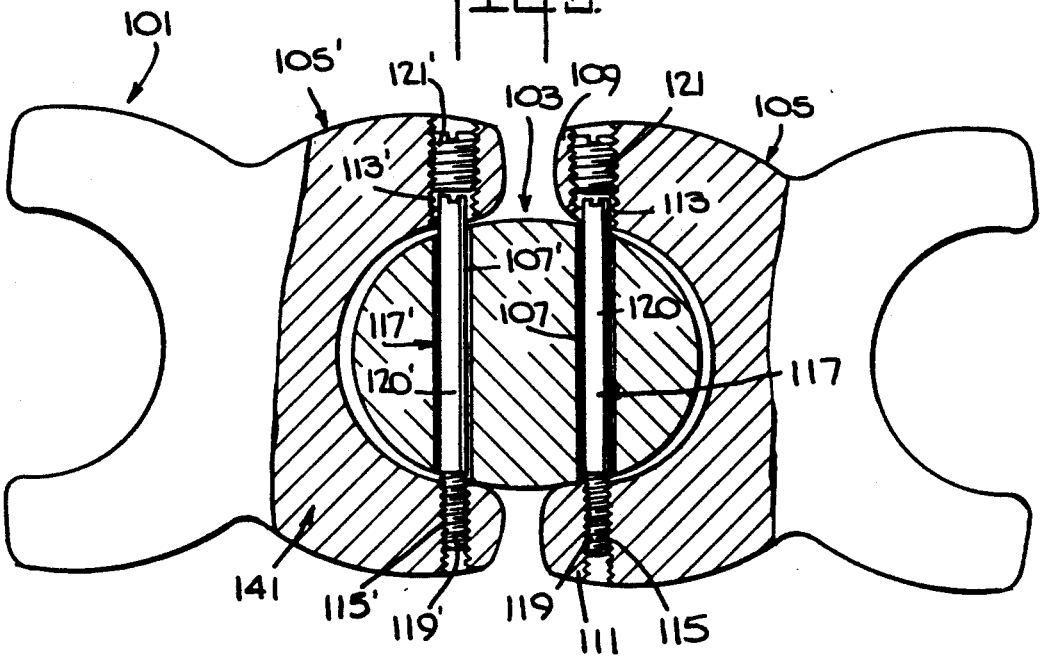
FIG. 3 is a cross-sectional view of the link assembly made in accordance with the invention having a central link member and an interconnected forked link member in which a partially threaded pin extends through the bore of the central link member and a portion of the bores of the forked link member, and in which a threaded screw occupies one of the forked link member bores for maintaining the pin within the bores.

Turning now to FIG. 3, a first embodiment of the inventive link assembly (generally designated at 101) is described. Link assembly 101 includes a central link member 103 and a forked link member 105 pivotally connected to link member 103, as described in more detail below. Link assembly 101 includes many of the same elements as link assembly 61 of the prior art.

Central link member 103 includes a central bore 107 extending completely therethrough. Forked link member 105 is fitted around central link member 103 and includes an upper arm 109 and a lower arm 111. Upper arm 109 includes a threaded opening or threaded bore 113 adapted for receiving a conventional set screw. Lower arm 111 includes a more narrow threaded opening or bore 115. Openings 113 and 115 and central bore 107 of central link member 103 are aligned with each other to form a continuous longitudinal opening when central link member 103 and forked link member are assembled.

To complete assembly, central bore 107 of link member 103 receives a pin member 117. Pin member 117 includes a lower threaded lower end 119 and an upper non-threaded or smooth portion 120. Smooth portion 120 of pin member 117 is inserted through bore 107 and is rotatable therein. Lower threaded end 119 is received only in threaded opening 115 of lower arm 111.

Thereafter, upper threaded bore 113 receives a threaded screw 121. Threaded screw 121 is screwed into threaded bore 113 until it abuts the upper end of pin member 117 which extends into a portion of threaded bore 113 (see FIG. 3).

Threaded screw 121 thus acts as a "plug" to prevent pin 117 from sliding out of central bore 107. Pin 117, though enabling link members 103 and 105 to pivotally rotate with respect to each other, is not physically connected to threaded screw 121. Therefore, in contrast to prior art embodiments, threaded screw 121 is not likely to become loosened within threaded bore 113. Even if pin 120 will loosen, because of being a hinge, screw 121 will plug its way out.

As shown in FIG. 3, a second forked link member 105' may be pivotally connected to central link member 103 by fitting it about the opposite end of link member 103. Link member 103 includes a second central bore 107' and forked link member 141 includes a pair of threaded openings or bores 113' and 115' which are aligned with central bore 107' as described before. A second pin member 117' and a second threaded screw 121' are fitted in the bores in an identical fashion.

Figure 5:
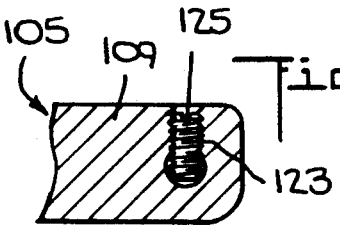
FIG. 5 is a cross-sectional view taken along line 5—5 of FIG. 4.
Figure 4:
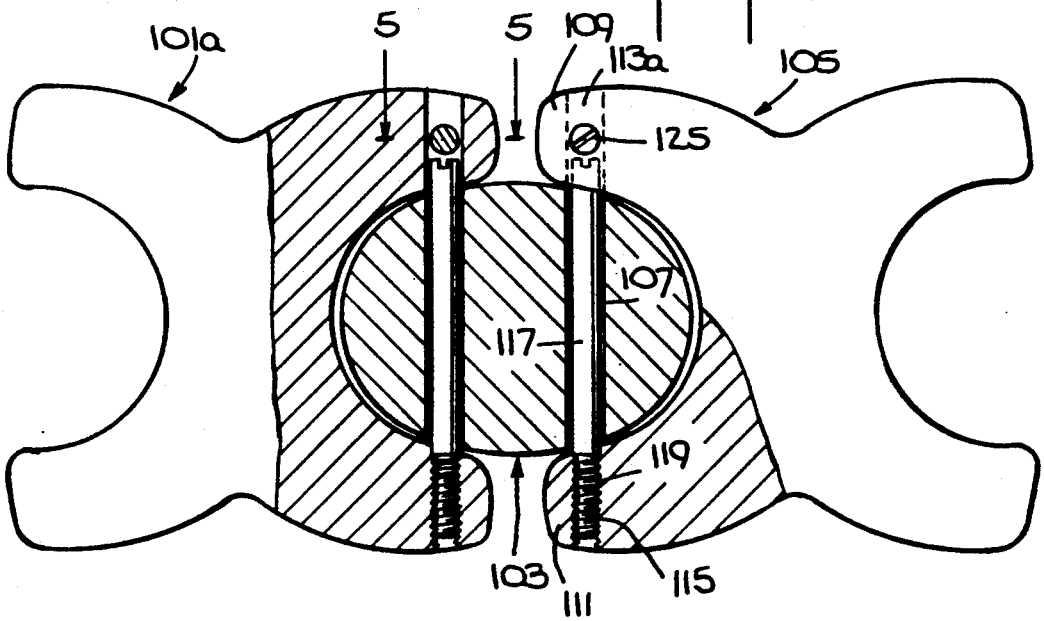
FIG. 4 is a cross-sectional view substantially similar to FIG. 3 in which the threaded screw is disposed perpendicular to the pin.

Turning now to FIGS. 4 and 5, a second link assembly made in accordance with the invention and generally indicated at **101*a* is described. As with the embodiment in FIG. 3, link assembly 101*a* includes a central link member 103 and a forked link member 105 pivotally connected to central link member 103. Unlike the embodiment in FIG. 3, however, upper arm 109 includes a non-threaded bore 113*a* which is aligned with central bore 107 during assembly. Instead of a threaded screw fitting into longitudinal axial bore 113*a*, a threaded screw 125 is instead received in a perpendicular threaded opening 123, as best shown in FIG. 5. In this manner, threaded screw 125 prevents access to bore 113*a*, thus stabilizing link construction and pre- venting any loosening of pin member 117**.

Figure 6:
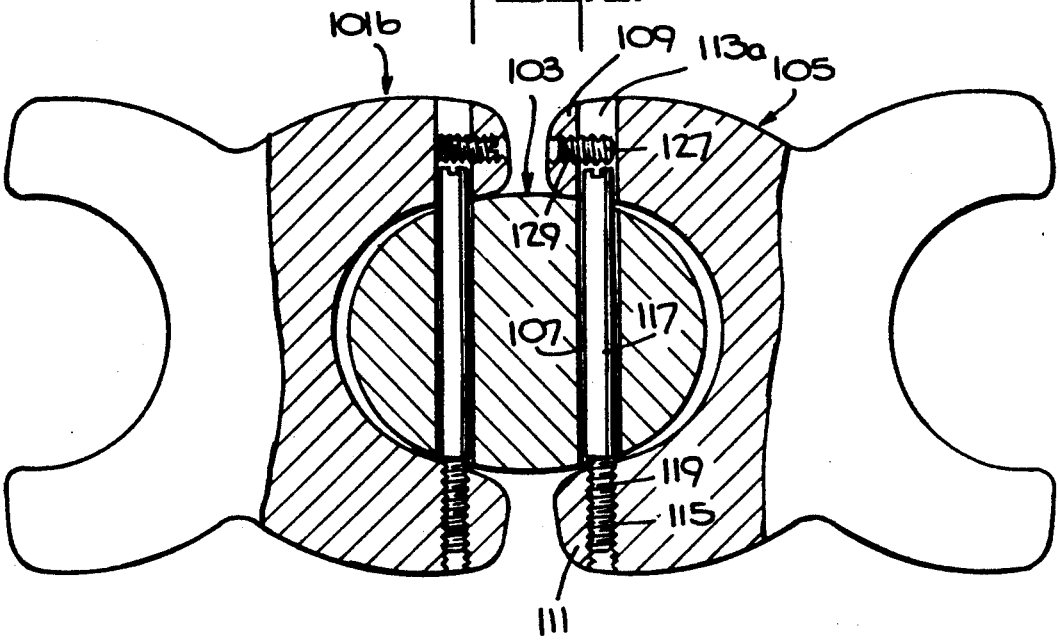
FIG. 6 is a cross-sectional view substantially similar to FIG. 3 in which the threaded screw comes in from the end of the forked link member and is also perpendicular to the pin.

Continuing now with FIG. 6, a third embodiment of link assembly of the invention is shown and is generally indicated at **101*b*. Link assembly 101*b* is the same as link assembly 101*a* except that it includes a threaded screw 127 which is screwed from the end of link member 105 (at upper arm 109) into a threaded opening 129. As before, threaded screw 127 is disposed perpendicular to pin member 117**.

In this embodiment, threaded screw 127 cannot become loosened because it is not involved in the pivoting action of the links 103 and 105. Nevertheless, threaded screw 127 prevents any possible withdrawal of pin member 117 by protruding into bore **113*a*of upper arm 109**.

Figure 7:
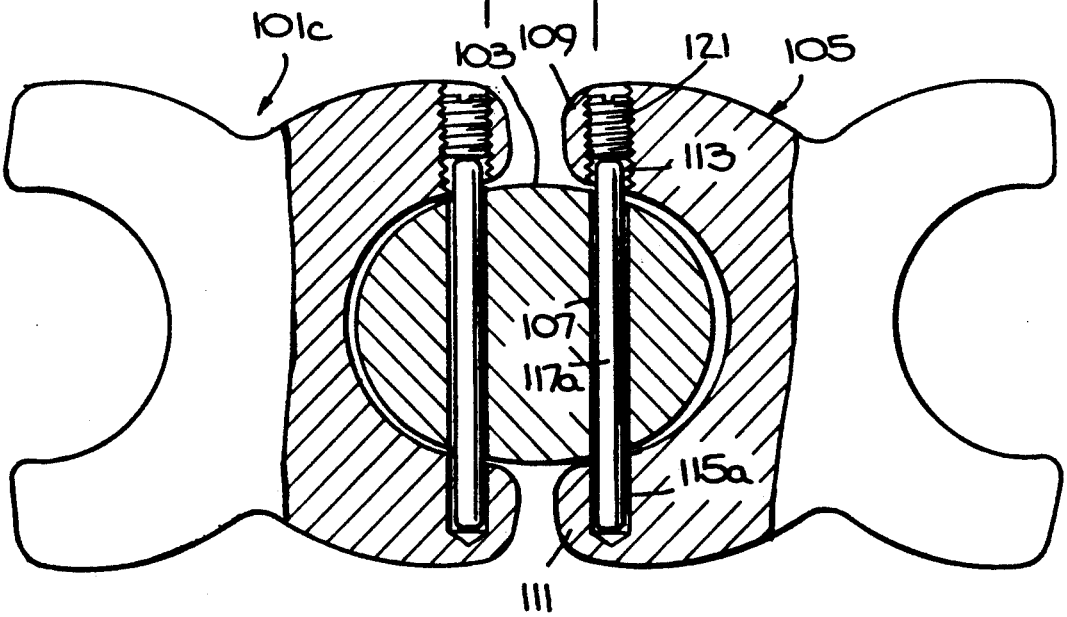
FIG. 7 is a cross-sectional view somewhat similar to FIG. 3 in which the pin is non-threaded and does not protrude through the edge of the lower arm of the forked link member and in which the threaded screw is disposed at one end for maintaining the pin within the bores.

Turning now to FIG. 7, a fourth embodiment of the inventive link assembly is generally indicated at **101*c*. Link assembly 101*c* is substantially similar to link assembly 101 illustrated in FIG. 4. In link assembly 101*c*, lower bore 115*a* in lower arm 111 is not threaded and also does not protrude out from the lower end of arm 111. Moreover, pin member 117*a* has no threading and is solid along its entire cylindrical length. Pin member 117*a* is blocked at its lower end by the bottom of lower bore 115*a* and is blocked at its top end by "plug" screw 121**, the latter in a manner similar to FIG. 4.

Link assembly **101*c* may be maintained by unscrewing threaded screw 121 in a conventional fashion. After unscrewing, pin member 117*a*** is accessible for either fixing or replacement purposes.

Figure 8:
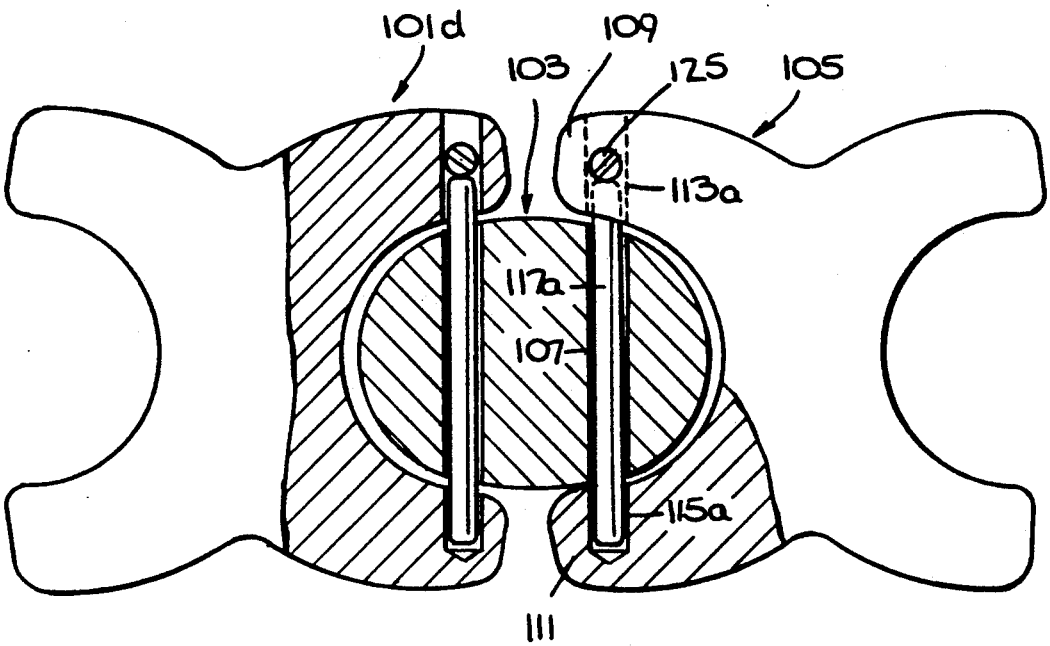
FIG. 8 is a cross-sectional view substantially similar to FIG. 7 in which the threaded screw is disposed perpendicular to the pin.

Referring to FIG. 8, a fifth embodiment of the inventive link assembly generally indicated at **101*d* is now described. Link assembly 101*d* is substantially similar to assembly 101*a* illustrated in FIGS. 4 and 5, except that it includes the non-protruding bore 115*a* and the non-threaded pin member 117*a* as described in FIG. 7. In this embodiment, after pin member 117*a* has been inserted into bores 107 and 115*a*, threaded screw 125 is received in the threaded opening in arm 109, which runs perpendicular to bores 113*a*, 107 and 115*a*. Threaded screw 125 acts to block any possible withdrawal of pin member 117*a***.

Figure 9:
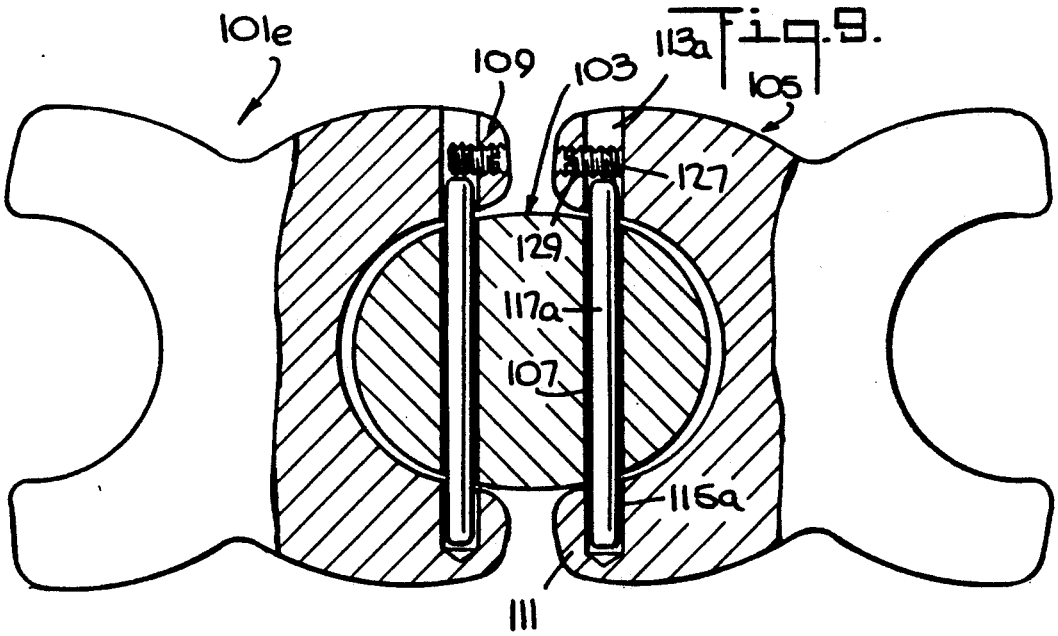
FIG. 9 is a cross-sectional view substantially similar to FIG. 7 in which the threaded screw comes in from the end of the forked link member perpendicular to the pin.

In FIG. 9, a sixth embodiment of the inventive link assembly is indicated at **101*e*. Link assembly 101*e* is substantially similar to assembly 101*b* described previously with respect to FIG. 6. As with assemblies 101*c* and 101*d* (FIGS. 7 and 8), assembly 101*e* includes a solid non-threaded cylindrical pin member 117*a* which extends through bore 107 located in central link member 103. Pin member 117*a* is blocked at its lower end by the bottom of lower bore 115*a* located in lower arm 111**.

In link assembly **101*e*, threaded screw 127 is received in threaded opening 129 in a manner identical to that described with respect to link assembly 101*b* illustrated in FIG. 6. Thus, threaded screw 127 protrudes into bore 113*a* located in upper arm 109 in order to prevent accidental removal of pin member 117*a*** therethrough.

Figure 10:
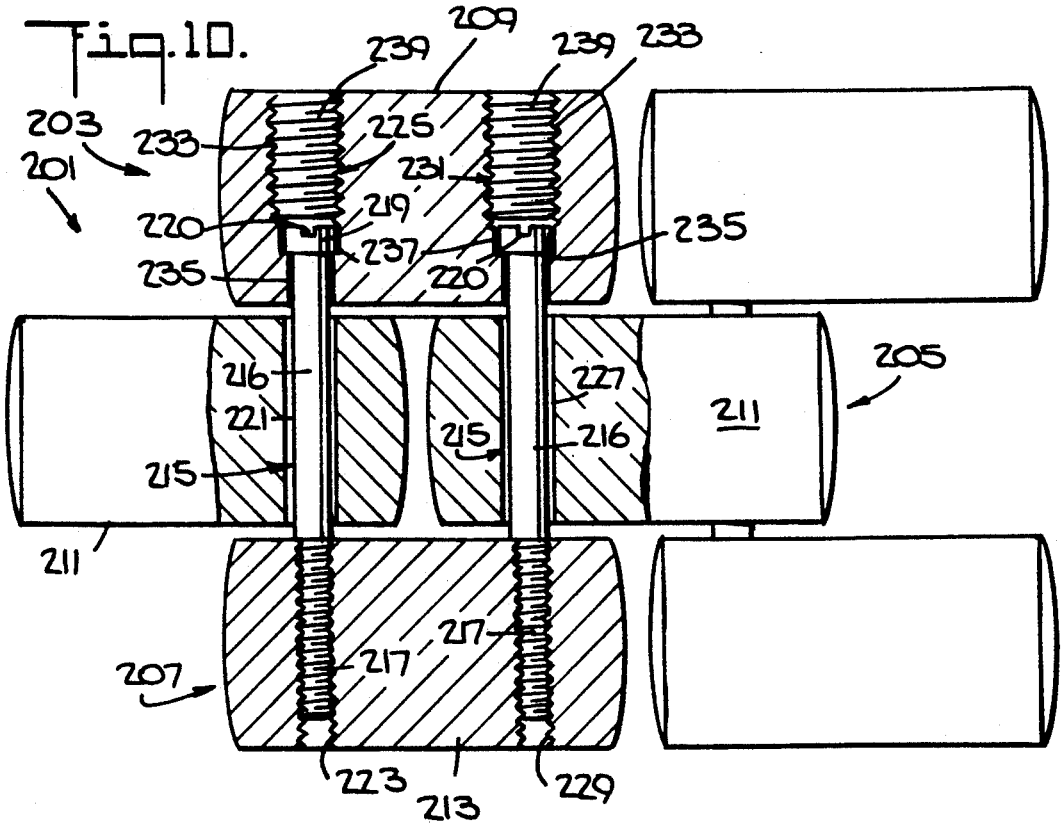
FIG. 10 is a cross-sectional view of a multi row link assembly made in accordance with the invention in which a partially threaded longitudinal pin extends through the aligned bores of the links and a threaded screw is provided in the bore of the upper link for maintaining the pin within the bores.

Referring now to FIG. 10, a three row link assembly 201 made in accordance with the invention is described. Link assembly 201 includes three rows of links, namely upper row 203, middle row 205 and bottom row 207 respectively. Upper row 203 includes a plurality of upper link members 209, while lower row 207 includes a plurality of lower link members 213. Link members 209 and 213 are substantially aligned with each other in link assembly 201. Middle row 205 also includes a plurality of middle link members 211 disposed in an offset relationship in assembly 201 with respect to link members 209 and 213, as illustrated in FIG. 10.

Each of middle link members 211 includes a first bore 221 located in the right portion of link member 211 and a second bore 227 located in the left portion of link member 211. Each of bores 221 and 227 is nonthreaded and has a substantially smooth annular surface. Bore 221 is aligned with a threaded bore 223 running through the left portion of lower link member 213 and a bore 225 extending through the left portion of upper link member 209 in assembly 201. Similarly, bore 227 of middle link member 205 is aligned with a threaded bore 229 extending through the lower link member 213 and a bore 231 extending through the right portion of upper link member 209.

Each of bores 225 and 231 extending through the left and right portions of upper link member 209 respectively includes an upper threaded portion 233, a non-threaded lower portion 235 and an annular lip 237 located above non-threaded portion 235. As will be described in more detail below, bores 225 and 231 are adapted to receive a set screw that is used for maintaining the integrity of assembly 201.

In assembly, bores 225, 221 and 223 are aligned to form a continuous longitudinally extending opening. Similarly, bores 231, 227 and 229 are also aligned to form a second continuous longitudinally extending opening. A pair of pin members 215 are inserted respectively into the two openings defined by the bores in the manner described below. Each of pin members 215 comprises an upper smooth cylindrical portion 216 and a lower threaded portion 217. Furthermore, each of pin members 215 includes a head 219 having a slot 220 sized for receiving the head of a screwdriver.

After pin members 215 are inserted into the longitudinal openings defined by the aligned bores of the link members, a screwdriver is used to turn each of pin members 215 so that threaded portions 217 are screwed into threaded bores 223 and 229 of lower link member 223. This process continues until heads 219 of pin members 215 are pressed against annular lips 237 of bores 225 and 231 located in upper link member 209.

In order to prevent the loosening of pin members 215 within the two longitudinally extending openings defined by the link member bores, threaded screws 239 are received in upper threaded portions 233 of bores 225 and 231 located in upper link member 209. Screws 239 are inserted until the bottoms thereof abut heads 219 of pin members 215, as shown in FIG. 10.

In the embodiment of FIG. 10, threaded screws 239 being separate and independent elements of the assembly and apart from pivotal action of the link prevent pin members 215 from loosening and/or escaping from the two openings defined by the link member bores. Nevertheless, pin members 215 are loosely and rotatably disposed within bores 221 and 227 of middle link 211, enabling middle link 211 to pivotally rotate with respect to upper link 209 and lower link 213.

Figure 12:
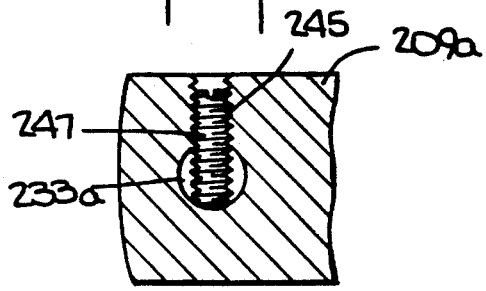
FIG. 12 is a cross-sectional view taken along line 12—12 of FIG. 11.
Figure 11:
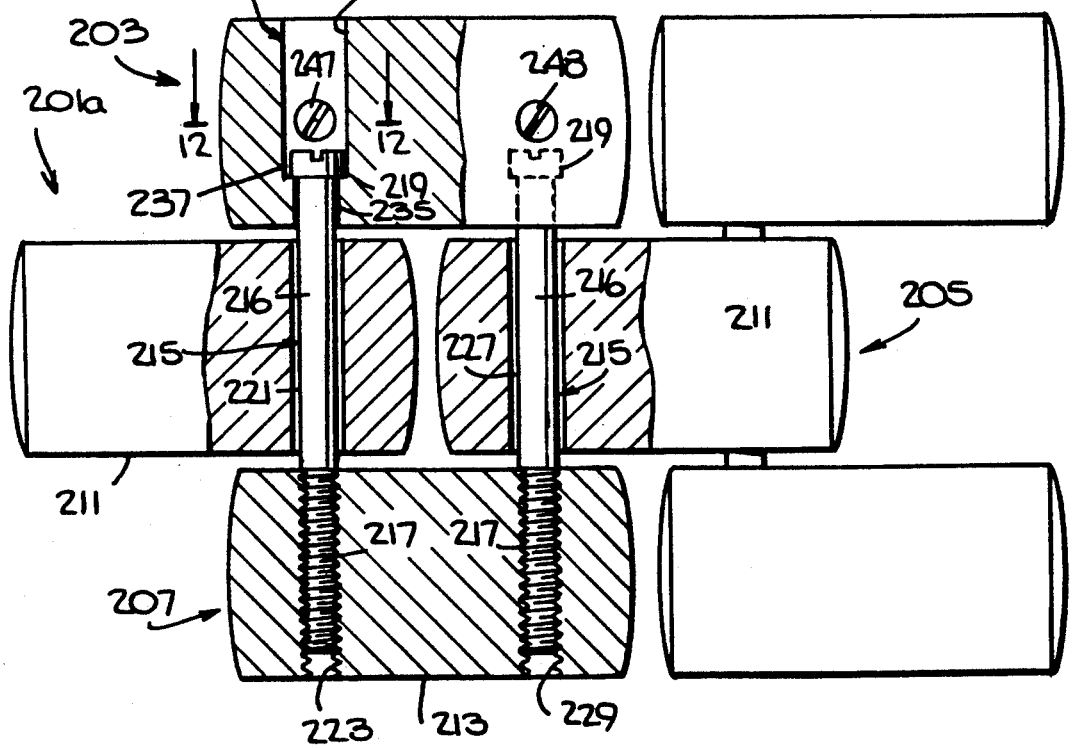
FIG. 11 is a cross-sectional view substantially similar to FIG. 10 in which the threaded screw is disposed perpendicular to the pin.

Turning now to FIGS. 11 and 12, a second embodiment of a multi row link assembly made in accordance with the invention and generally indicated at **201*a* is shown. In this embodiment, upper link member 209*a* includes bores 225*a* each having a non-threaded or smooth upper portion 233*a* and a non-threaded lower portion 235. Bores 225*a* are aligned with the bores in middle and lower link members 211 and 213** in order to define a pair of continuous longitudinally extending openings through the link members.

In addition, upper link member **209*a* includes a pair of perpendicular threaded openings 245 which lead to non-threaded upper portions 233*a* of bores 225*a* (see FIG. 12). In this assembly, threaded screws 247 are received in perpendicular threaded opening 245 so that a portion of threaded screws 247 extend into non-threaded upper portions 233*a* of bores 225*a*. In this manner, threaded screws 247 preclude access to pin members 215, thus stabilizing link construction and preventing any loosening of pin members 215**.

Figure 13:
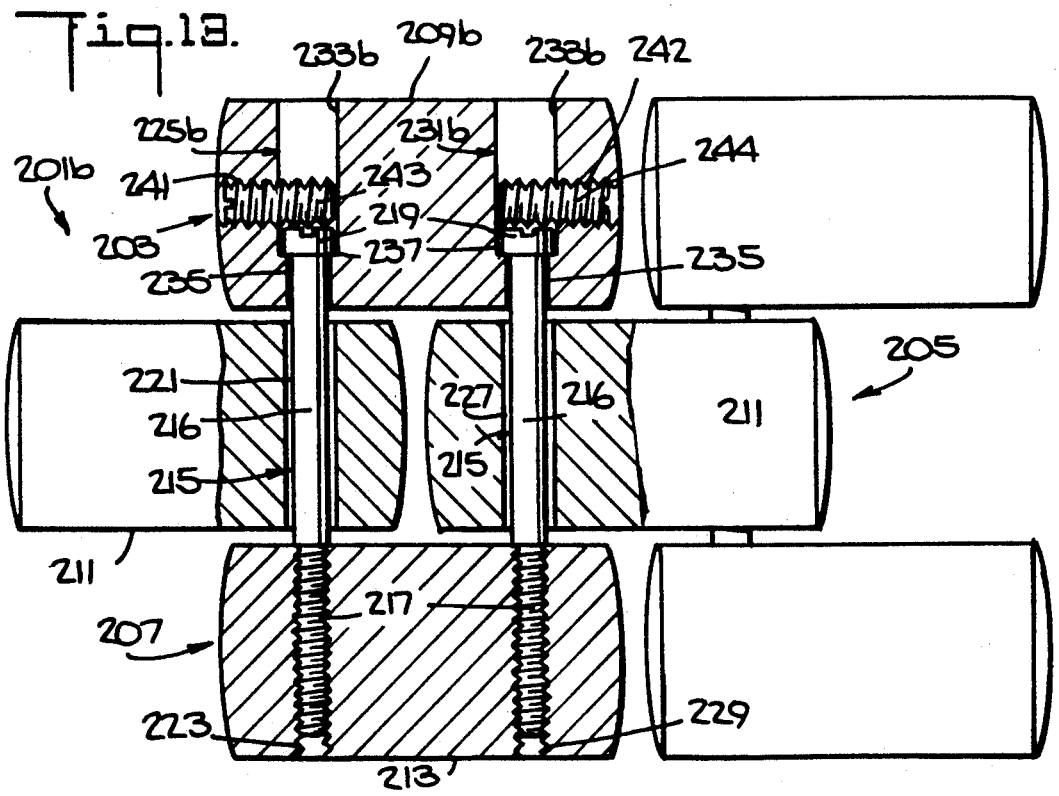
FIG. 13 is a cross-sectional view substantially similar to FIG. 10 in which the threaded screw comes in from the end of the upper link.

Continuing now with FIG. 13, a third embodiment of a multi row link assembly made in accordance with the invention is described and is generally indicated at **201*b*. Link assembly 201*b* is substantially the same as link assembly 201*a*. Each of upper links 209*b* include a pair of bores 225*b* and 231*b* having upper portions 233*b* and lower portions 235. Bores 225*b* and 231*b* are aligned with the bores in middle and lower link members 211 and 213 in the usual fashion. Upper link member 209*b* also includes a pair of perpendicular extending threaded openings 241 and 242 which extend from either end of link member 209*b* and which lead into upper portions 233*b* of bores 225*b* and 231*b***.

In the assembly, a pair of threaded screws 243 and 244 are received in threaded openings 241 and 242 respectively so that a portion of screws 243 and 244 extend into upper portions **233*b* of bores 225*b* and 231*b*. As before, threaded screws 243 and 244 prevent access to bores 225*b* and 231*b*, thereby stabilizing link construction and preventing the loosening of pin members 215** received within the aligned bores of the link members.

Figure 14:
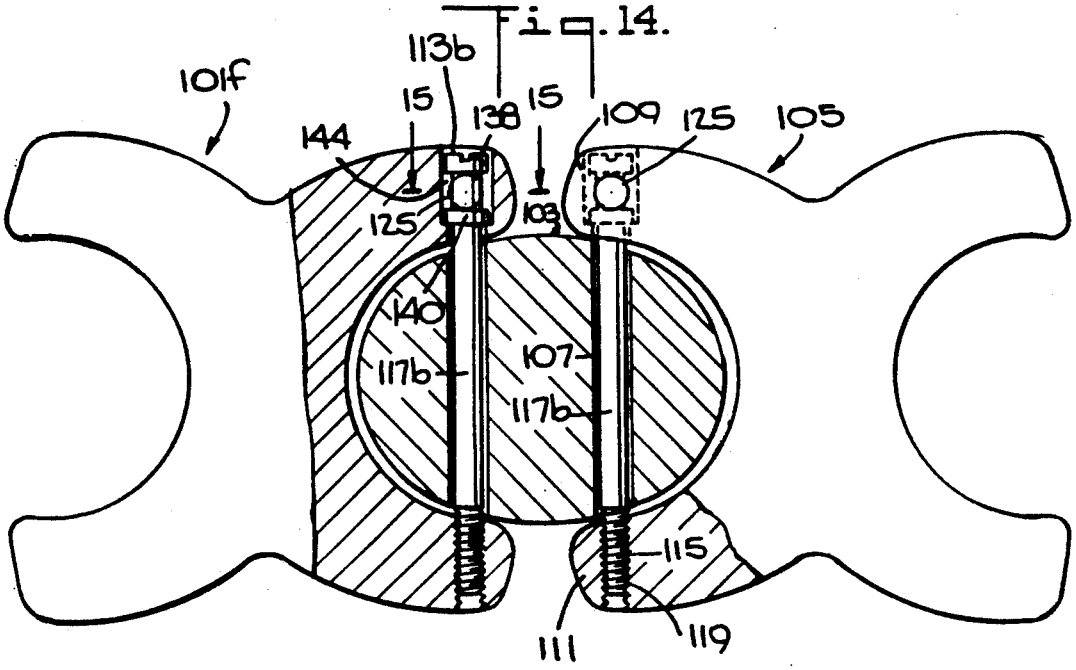
FIG. 14 is a cross-sectional view somewhat similar to FIG. 4 in which the pin has a groove located adjacent the head of the pin and in which the threaded screw is disposed perpendicular to the pin and is received in the grove.
Figure 15:
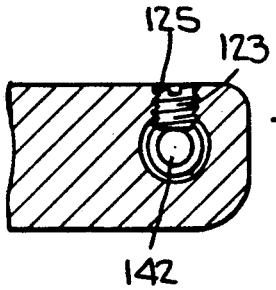
FIG. 15 is a cross-sectional view taken along line 15—15 of FIG. 14.

Turning now to FIGS. 14 and 15, a seventh forked link assembly made in accordance with the invention and generally indicated at **101*f* is described. Link assembly 101*f* is substantially similar to assembly 101*a* illustrated in FIGS. 4 and 5. Link assembly 101*f* includes a central link member 103 and a forked link member 105 pivotally connected to central link member 103. Unlike the embodiment in FIGS. 4 and 5, however, pin member 117*b* includes a head 138, an annular rib 140 and a thinned portion 142 located therebetween for defining an annular groove 144. Head 138, rib 140 and thinned portion 142 are located at the topmost portion of pin 117*b* and are received in upper bore 113*b* when pin member 117*b* is disposed through the continuous longitudinal opening formed by the aligned bores in link members 103 and 105. This is best illustrated in FIG. 14**.

Thereafter, a threaded screw 125 is received in perpendicular threaded opening 123 so that one end of threaded screw 125 is located in groove 144 and presses against thinned portion 142 of pin member **117*b*. In this manner, threaded screw 125 prevents pin member 17*b* from sliding out of central bore 107, and also stabilizes link construction and prevents any loosening of pin member 117*b***.

Figure 16:
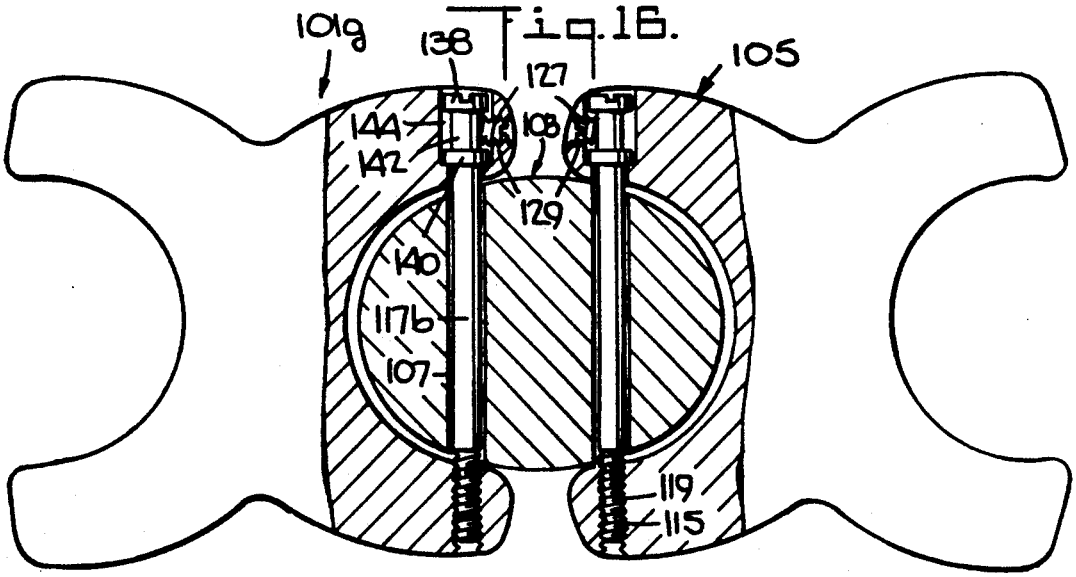
FIG. 16 is a cross-sectional view substantially similar to FIG. 14 in which the threaded screw comes in from the end of the forked link member perpendicular to the pin.

Continuing now with FIG. 16, an eighth embodiment of the forked link assembly of the invention is shown and is generally indicated at **101*g*. Link assembly 101*g* is the same as link assembly 101*f* except that it includes a threaded screw 127 which is screwed from the end of link member 105 (at upper arm 109) into a threaded opening 129. As before, threaded screw 127 is disposed perpendicular to pin member 117*b*. One end of threaded screw 127 presses against thinned portion 142 of pin member 117*b*** to prevent the removal thereof.

Figure 17:
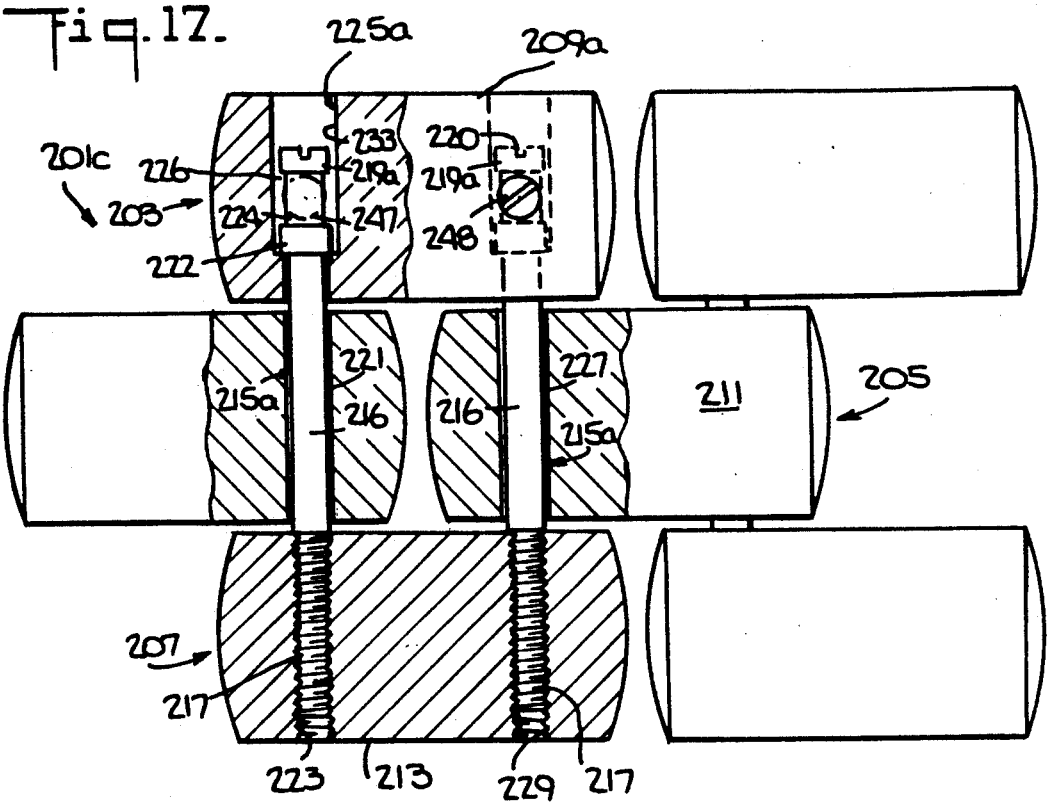
FIG. 17 is a cross-sectional view substantially similar to FIG. 11 in which the pin has a groove located adjacent the head of the pin and in which the threaded screw is disposed perpendicular to the pin.

Referring now to FIG. 17, a fourth embodiment of a multi row link assembly made in accordance with the invention and generally indicated at **201*c* is illustrated. Link assembly 201*c* is substantially similar to link assembly 201*a* illustrated in FIGS. 11 and 12, except that it includes a pin member 215*a* which is virtually identical to the pin members used in the embodiment for the forked link assembly illustrated in FIGS. 14–16 described herein. More specifically, each pin member 215*a* comprises an upper smooth cylindrical portion 216 and a lower threaded portion. Furthermore, each pin members 215 include a head 219*a* having a slot 220 sized for receiving the head of a screwdriver and an annular rib 222 located below head 219*a*. Between head 219*a* and annular rib 222 is a thinned portion 224 defining an annular groove 226**.

In assembly, threaded screws 247 are received in a perpendicular threaded openings (not shown) so that the ends of threaded screws 247 press against thinned portions 224 of pin members 215*a*. In this manner, threaded screws 247 prevent pin members 215*a* from loosening and also prevent access to pin members 215*a*.

Figure 18:
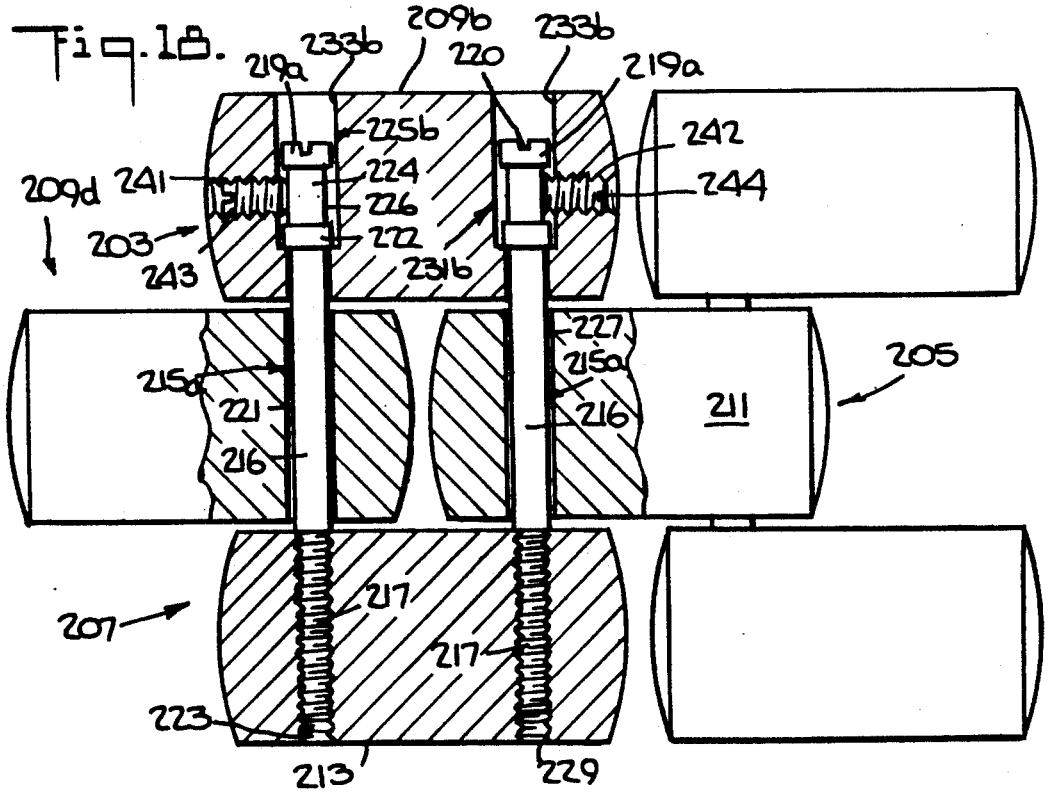
FIG. 18 is a cross-sectional view substantially similar to FIG. 17 in which the threaded screw comes in from the end of the upper link.

Continuing now with FIG. 18, a fifth embodiment of a multi row link assembly made in accordance with the invention is described and is generally indicated at 201*d*. Link assembly 201*d* is substantially the same as link assembly 201*c*. Each of upper links 209*b* includes a pair of bores 225*b* and 231*b* having upper portions 233*b* and lower portions 235*b*. Bores 225*b* and 231*b* are aligned with the bores in the middle and lower link members 211 and 213 in the usual fashion. Upper link member 209*b* also includes a pair of perpendicularly extending threaded openings 241 and 242 which extend from either end of link member 209*b* and which lead into upper portions 233*b* of bores 225*b* and 231*b*.

Each of pin members 215*a* includes a head 219*a*, an annular rib 222 and a thinned portion 224 located therebetween. In assembly, a pair of threaded screws 243 and 244 is received in threaded openings 241 and 242 respectively so that the ends of screws 243 and 244 press against thinned portions 224 of pin members 215*a*. As before, threaded screws 243 and 244 extend into bores 225*b* and 231*b*, thereby stabilizing link construction and preventing the loosening of pin members 215*a* within the aligned bores of the link members.

Although other embodiments of the inventive link assembly are possible, such embodiments must include a hinge mechanism for enabling the link members to pivotally rotate and a separate mechanism or means for maintaining the link members in assembled condition.

It will thus be seen that the objects set forth above, among those made apparent from the preceding description, are efficiently attained and, since certain changes may be made int he above constructions without departing from the spirit and scope of the invention, it is intended that al matter contained in the above description as shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

I claim:

1. A link assembly for a link bracelet comprising:

first link member having a first bore therethrough, and a second link member having a second and third bore therethrough, said second bore and said third bore disposed on opposite sides of and axially aligned with said first bore;

a longitudinal pin extending through said first bore and rotatable therein, said pin also extending through a first portion of said second bore and at least a portion of said third bore for enabling said first link member to pivotally rotate with respect to said second link member; and a threaded member occupying a second portion of the second bore for maintaining the pin within said bores.

2. The assembly of claim 1, wherein said longitudinal pin includes a non-threaded portion received in said first bore.

3. The assembly of claim 2, wherein said threaded member abuts said pin.

4. The assembly of claim 2, wherein said second bore is at least partially threaded for receiving said threaded member.

5. The assembly of claim 2, wherein said second link member further includes a threaded opening leading to said second bore and perpendicular thereto.

6. The assembly of claim 5, wherein said threaded opening receives said threaded member.

7. The assembly of claim 6, wherein a portion of said threaded member extends into said second bore for preventing movement of said pin in an axially direction.

8. The assembly of claim 7, wherein said portion of said threaded member is located beyond said pin in said second bore.

9. The assembly of claim 7, wherein said portion of said threaded member presses against said pin.

10. The assembly of claim 2, wherein said second bore includes an annular lip and wherein aid pin includes a head which abuts against said annular lip when said pin is extended through said first bore and a portion of said second bore.

11. The assembly of claim 1, wherein said third bore is at least partially threaded.

12. The assembly of claim 11, wherein said pin further includes a threaded portion screwingly received in said at least partially threaded third bore.

13. The assembly of claim 1, wherein said third bore extends only partially through said second link member.

14. The assembly of claim 13, wherein said pin is received within said third bore located in said second link member.

15. A link assembly for a link bracelet comprising:

a first link member having a first bore and a second bore, a second link member having a third bore axially aligned with said first bore, and a third link member having a fourth bore axially aligned with said second bore;

a first longitudinal pin extending through said first bore and rotatable therein, said first pin also extending through a first portion of said third bore for enabling said first link member to pivotally rotate with respect to said second link member;

a second longitudinal pin extending through said second bore and rotatable therein, said second pin also extending through a first portion of said fourth bore for enabling said first link member to pivotally rotate with respect to said third link member; and a first threaded member occupying a second portion of the third bore for maintaining said first pin within said first and third bores; and a second threaded member occupying a second portion of said fourth bore for maintaining said second pin within said second and fourth bores.

16. The assembly of claim 15, wherein said second link member also has a fifth bore axially aligned with said first bore and disposed opposite said third bore, and wherein said third link member also has a sixth bore axially aligned with said second bore and disposed opposite said fourth bore.

17. The assembly of claim 16, wherein each of said fifth and sixth bores are at least partially threaded for receiving a threaded portion of said first and second pins.

18. The assembly of claim 16, wherein each of said fifth and sixth bores extends only partially through said second and third link members.

19. The assembly of claim 15, further including a fourth link member having a fifth bore axially aligned with said first bore and disposed opposite said third bore, and a fifth link member having a sixth bore axially aligned with said second bore and disposed opposite said fourth bore.

20. The assembly of claim 15, wherein said first threaded member abuts said first pin wherein said second threaded member abuts said second pin.

21. The assembly of claim 15, wherein said third bore is at least partially threaded for receiving said first threaded member and wherein said fourth bore is at least partially threaded for receiving said second threaded member.

22. The assembly of claim 15, wherein said second link member further includes a threaded opening leading to said third bore and perpendicular thereto and wherein said third link member further includes a threaded opening leading to said fourth bore and perpendicular thereto.

23. The assembly of claim 22, wherein said second link member threaded opening is adapted for receiving said first threaded member and wherein said third link member threaded opening is adapted to receive said second threaded member.

24. The assembly of claim 15:

wherein said third bore includes an annular lip and wherein said first pin includes a head which abuts against said third bore annular lip when said first pin is extended through a portion of said third bore; and wherein said fourth bore includes an annular lip and wherein said second pin includes a head which abuts against said fourth bore annular lip when said second pin is extended through a portion of said fourth bore.

25. A link assembly for a link bracelet comprising:

a first link member having a first bore therethrough, a second link member having a second bore therethrough, a third link member having a third bore therethrough, said second and said third bores disposed at opposite sides of and axially aligned with said first bore;

a longitudinal pin extending through said first bore and rotatable therein, said pin extending through a first portion of said second bore and at least a portion of said third bore for enabling said first link member to pivotally rotate with respect to said second and third link members; and a threaded member occupying a second portion of said second bore for maintaining said pin within said bores;

wherein said pin includes a threaded portion and said third bore is at least partially threaded for receiving said pin threaded portion.

26. The assembly of claim 25, wherein said threaded member abuts said pin.

27. The assembly of claim 25, wherein said second bore is at least partially threaded for receiving said threaded member.

28. The assembly of claim 25, wherein said second link member further includes a threaded opening leading to said second bore and perpendicular thereto.

29. The assembly of claim 28, wherein said threaded opening of said second link member receives said threaded member.

30. The assembly of claim 29, wherein a portion of said threaded member extends into said second bore for preventing movement of said pin in an axial direction.

31. The assembly of claim 30, wherein said portion of said threaded member is located beyond said pin in said second bore.

32. The assembly of claim 31, wherein said portion of said threaded member presses against said pin.

33. The assembly of claim 25, wherein said second bore includes an annular lip and wherein said pin includes a head which abuts against said annular lip when said pin is extended through a portion of said second bore.

* * * * *